US006312071B1

(12) United States Patent
Kawamura et al.

(10) Patent No.: US 6,312,071 B1
(45) Date of Patent: Nov. 6, 2001

(54) SCANNING TYPE IMAGE FORMATION APPARATUS

(75) Inventors: Iwao Kawamura; Kazuhiro Murakami; Ryoma Suzuki; Kensuke Izuma; Naoki Kiyohara; Kiyokazu Namekata, all of Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/202,177

(22) PCT Filed: Jul. 11, 1997

(86) PCT No.: PCT/JP97/02409

§ 371 Date: Mar. 4, 1999

§ 102(e) Date: Mar. 4, 1999

(87) PCT Pub. No.: WO98/02311

PCT Pub. Date: Jan. 22, 1998

(30) Foreign Application Priority Data

Jul. 12, 1996 (JP) ..... 8-183849

(51) Int. Cl.[7] ..... B41J 3/00; B41J 29/393; B41J 23/00

(52) U.S. Cl. ..... 347/2; 347/19; 347/37

(58) Field of Search ..... 347/2, 19, 16, 347/37, 8

(56) References Cited

U.S. PATENT DOCUMENTS 5,975,674 * 11/1999 Beauchamp et al. ..... 347/19
5,980,010 * 11/1999 Stephenson ..... 347/2

FOREIGN PATENT DOCUMENTS 58-181658 10/1983 (JP) .
2-128846 5/1990 (JP) .
3-227653 10/1991 (JP) .
5-220978 8/1993 (JP) .
6-064168 3/1994 (JP) .

* cited by examiner

*Primary Examiner*—John Barlow
*Assistant Examiner*—An H. Do
(74) *Attorney, Agent, or Firm*—Dellett and Walters

(57) ABSTRACT

When a carriage 16 is positioned in an end portion in the direction indicated by arrow B in a scanning area thereof, an attachment 46 is in contact with a main frame side wall 1*a* of a plotter 1, and turns in the direction indicated by arrow D against the enabling force in the direction indicated by arrow C of a helical torsion coil spring 50, so that an image position detector 40 is stored in a storage unit 16*c* of the carriage 16.

9 Claims, 8 Drawing Sheets

SCANNING TYPE IMAGE FORMATION APPARATUS

TECHNICAL FIELD

The present invention relates to a scanning type image formation apparatus having scanning means such as a carriage for scanning in a predetermining direction, in which the scanning means is scanned in a predetermining direction to form an image on a recording medium.

BACKGROUND ART

There are known, as output devices of computers and workstations, an image forming apparatus employing an ink-jet system in which ink is ejected to form an image on a recording medium, and an image forming apparatus employing an electrophotography. Of those apparatuses, as one having scanning means for scanning in a predetermining direction, in which the scanning means is scanned in a predetermining direction to form an image on a recording medium, for example, there is widely known an image forming apparatus employing an ink-jet system.

The image forming apparatus employing an ink-jet system comprises, for example, a print head for ejecting ink, a carriage on which the print head is mounted, said carriage reciprocating (scanning) in a predetermined direction, and a recording medium conveying device for conveying recording medium in a direction intersecting perpendicularly to the predetermined direction.

In the event that an image is recorded on a recording medium, the recording medium in the course of conveyance by the recording medium conveying device is temporarily stopped, and while the carriage is reciprocated in the predetermined direction, ink is ejected from the print head in accordance with an image signal carrying image information to form a band of image on a portion located at an image formation area of the recording medium on which area images are to be formed. Thereafter, the recording medium is fed by a band of width and stopped, and then again while the carriage is reciprocated in the predetermined direction, ink is ejected from the print head in accordance with the image signal carrying image information to form an image on a new portion located at the image formation area, of the recording medium. Such a performance is repeated to form an image.

Width (corresponding to a size with respect to a scanning direction of the carriage) of the scanning type image formation apparatus as mentioned above is generally determined by width of the recording medium and width of the scanning means. The shorter width of the scanning type image formation apparatus is more convenient in conveyance and installation. In order to shorten this width, the width of the scanning means may be shortened. However, there is a limit in shortening of width.

Now, for example, in case of a color image formation apparatus employing an ink-jet system, a carriage serves as scanning means. The carriage is loaded with at least four print heads. Thus, the carriage has an extended width per se. Further, it is needed for the color image formation apparatus to provide a registration with great accuracy, that is, an exact overlapping of the respective colors. For this reason, it happens that the carriage is loaded with a detection device for detecting a position of image formed with ink of each of the print heads at the time of the initial set up or an exchange of the print heads. In this case, it is usual that the detection device is mounted on the carriage in such a manner that it projects on an edge with respect to the scanning direction of the carriage. Accordingly, width of the carriage is extended by the corresponding projection of the detecting device.

DISCLOSURE OF THE INVENTION

In view of the foregoing, it is an object of the present invention is to provide a scanning type image formation apparatus in which even if additional means such as a detection device is mounted thereon, there is no need to extend the corresponding width.

The present invention has been made to attain the above-mentioned object and is to provide a first scanning type image formation apparatus having scanning means for scanning in a predetermined direction, in which said scanning means is scanned in the predetermined direction to form an image on a recording medium, said scanning type image formation apparatus comprising:

(1) attachment means attached to an edge of said scanning means in the predetermined direction, said attachment means performing a predetermined function; and (2) moving means for moving said attachment means in such a manner that when said attachment means performs the predetermined function, a part or the whole of said attachment means projects from the edge of said scanning means.

In order to accomplish the above-mentioned object, there is provided a second scanning type image formation apparatus having scanning means for scanning in a predetermined direction, in which said scanning means is scanned in the predetermined direction to form an image on a recording medium, said scanning type image formation apparatus comprising:

(3) attachment means attached to an edge of said scanning means in the predetermined direction, said attachment means performing a predetermined function; and (4) moving means for moving said attachment means in such a manner that when said attachment means performs the predetermined function, a part or the whole of said attachment means projects from the edge of said scanning means, and when said scanning means is located at an edge side in the predetermined direction within the scanning range, a part or the whole of the attachment means is stored in an inside of said scanning means.

In the first or second scanning type image formation apparatus as mentioned above, it is preferable that (5) said attachment means is an image matching apparatus for detecting a position of an image formed on a recording medium to establish a matching of the image formed on the recording medium.

In order to accomplish the above-mentioned object, there is provided a third scanning type image formation apparatus having a carriage for scanning in a predetermined direction, in which said scanning means is scanned in the predetermined direction to form an image on a recording medium, said carriage comprising:

(6) a main frame section for scanning the predetermined direction;

(7) a moving section projecting in the predetermined direction with respect to said main frame section, said moving section being movably fixed on said main frame section in such a manner that said moving section is movable in the predetermined direction.

In the third scanning type image formation apparatus as mentioned above, it is acceptable that (8) said moving section loads ink tanks for supplying inks to print heads for ejecting inks.

Further, in the third scanning type image formation apparatus as mentioned above, it is acceptable that (9) said moving section loads a junction substrate for supplying signals and electric power.

BEST MODE FOR CARRYING OUT THE INVENTION

Figure 1:
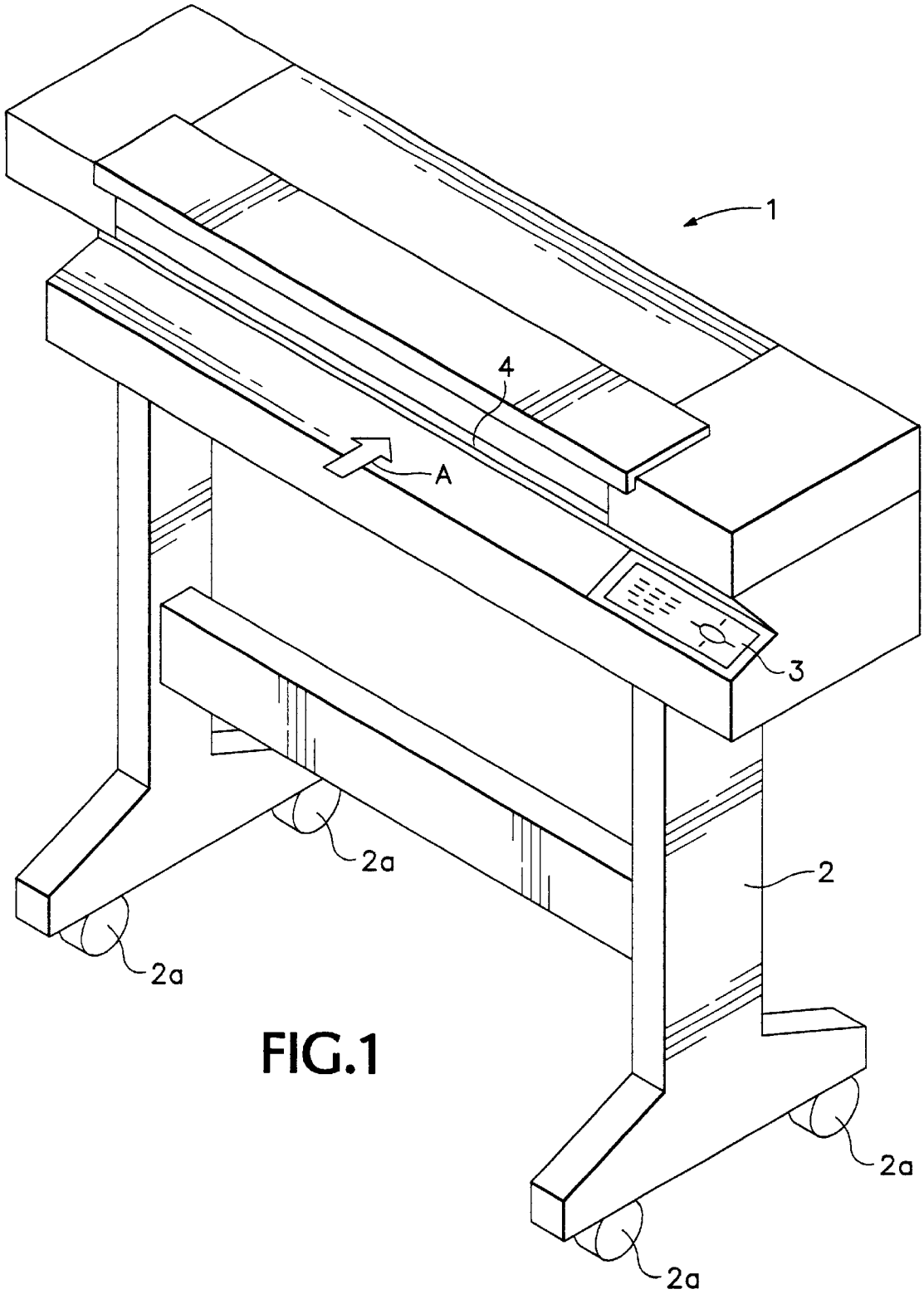
FIG. 1 is a perspective view showing exemplarily a schematic construction of a plotter according to a scanning type image formation apparatus of the present invention.

Hereinafter, embodiments of a scanning type image formation apparatus of the present invention will be described with reference to the drawing.

A plotter 1 is fixed on the top of a stand 2 equipped with casters 2*a*. The plotter 1 has a final control element 3 for operating the plotter 1. Operating various types of switches and the like provided on the final control element 3 permits instructions for a sheet size, on-line/off-line, a command, etc. A recording sheet, which is inserted into a recording sheet insertion inlet 4 from an arrow A direction, is conveyed into the inside of the plotter 1 in accordance with an instruction inputted through the final control element 3, and is discharged after printing for an image.

Figure 2:
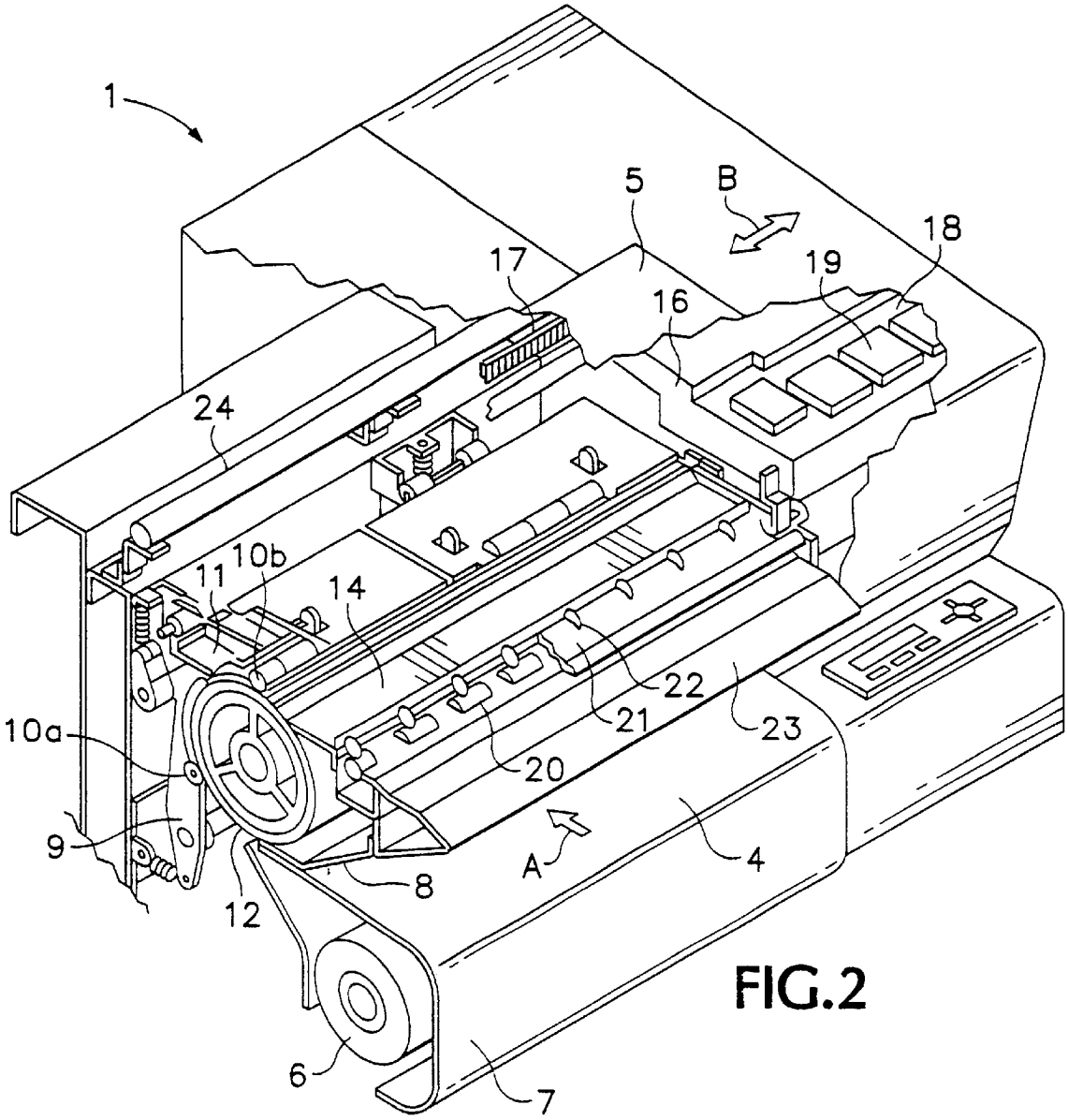
FIG. 2 is a perspective view of a passage from an insertion of a recording sheet to a discharge of the recording sheet in the plotter shown in FIG. 1, in which the plotter is shown on an open basis.

Next, there will be described a conveyance passage for recording sheets and a print (image forming) process with reference to FIG. 2.

The plotter 1 may perform a printing selectively either on a recording sheet (a cut sheet) inserted from the recording sheet insertion inlet 4 and a recording sheet (a rolled sheet) 6 wound as a roll. Here, there will be described a conveyance passage for recording sheets inserted from the recording sheet insertion inlet 4.

A recording sheet (for example, a large-sized cut sheet) is regularly placed on a cover 7 for the rolled sheet 6 and is inserted into the recording sheet insertion inlet 4 from an arrow A direction. The recording sheet thus inserted passes between the cover 7 and an upper guide 8, and reaches the upper portion of a print board 14, while being supported by both a sheet conveyance roller 10*a* rotatably fixed on a lower conveyance roller supporting plate 9 and a driven roller 10*b* rotatably fixed on an upper conveyance roller supporting plate 11, and a drive roller 12. The recording sheet, which has passed through the upper portion of the print board 14, is discharged while being supported by a discharge roller 20 and spurs 22. The spurs 22 are rotatably fixed on a spur plate 21.

The plotter 1 has a carriage 16 (an example of the scanning means referred to in the present invention) which reciprocates in an arrow B direction. The carriage 16 has a head holder 18 on which four print heads 19 accommodating four types of color ink (for example, cyan, magenta, yellow and black of inks), respectively, are mounted. The carriage 16 is fixed on a belt 17 which is coupled with a driving motor (not illustrated). The belt 17 reciprocates in an arrow B direction in accordance with a forward-backward rotation of the driving motor. Reciprocation of the belt 17 in the arrow B direction (an example of the predetermined direction referred to in the present invention) causes the carriage 16 to reciprocate in the arrow B direction in accordance with a guide rail 24.

A cut sheet is intermittently conveyed in a direction perpendicularly intersecting to the arrow B direction. When an image is formed on the cut sheet, the cut sheet is temporarily stopped, and while the carriage 16 reciprocates in the arrow B direction, ink is ejected in accordance with image information applied to the print heads 19 so that a band of image is formed on a portion, of the cut sheet, which portion is located at an image forming area. Thereafter, the cut sheet is conveyed by a predetermined length so that a subsequent band of image is formed on a new portion of the cut sheet, which is located at the image forming area. This operation is repeated throughout the overall length of the cut sheet. Thus, a color image is formed on the cut sheet. The cut sheet on which the color image is formed is discharged along a discharge guide 23 while being supported by the discharge roller 20 and the spurs 22.

Figure 3:
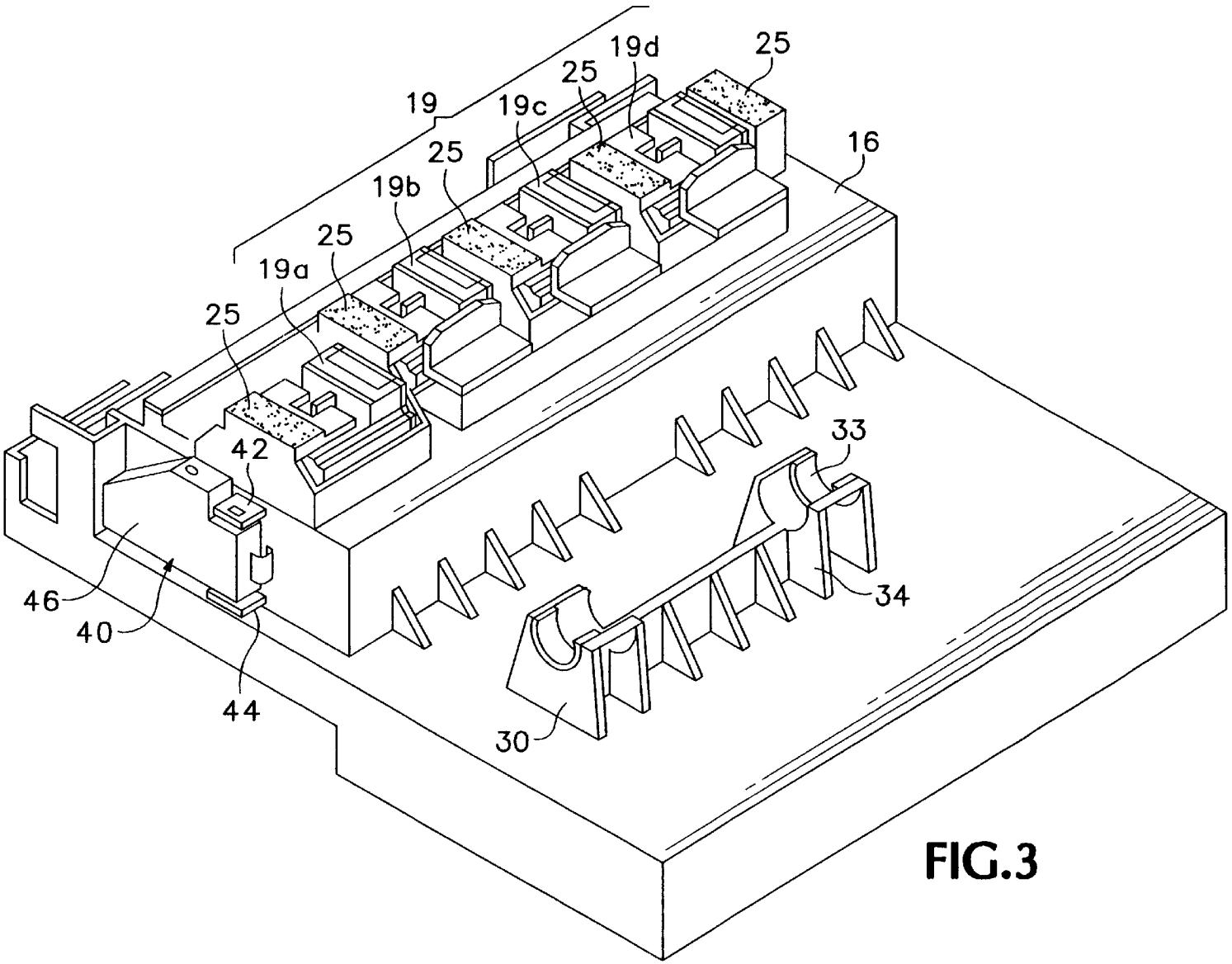
FIG. 3 is a perspective view of the bottom of a carriage.

Next, there will be described portions of the bottom of the carriage 16 with reference to FIG. 3.

As mentioned above, the carriage 16 is loaded with the print heads 19. Further, the carriage 16 has a bearing section 30 which is in contact with the guide rail 24 and an image position detector (an example of the attachment means referred to in the present invention) 40 for detecting a position of an image formed on a recording medium to establish a matching of the image formed on the recording medium. A function of detecting the position of the image is an example of the predetermined function referred to in the present invention.

The print heads 19 comprise a black print head 19*a* for ejecting black ink, a cyan print head 19*b* for ejecting cyan of ink, a magenta print head 19*c* for ejecting magenta of ink, and a yellow print head 19*d* for ejecting yellow of ink. In the vicinity of each of the respective color print heads 19*a*, 19*b*, 19*c* and 19*d*, there is disposed an absorber 24 for absorbing inks adhered to wipers (disposed at the plotter main frame side, but not illustrated) for wiping stains of the print heads 19 to prevent the wipers from getting dirty.

The bearing section 30 has two horseshoe-shaped bearings 33 and a bearing member 34 for supporting those bearings 33, and is fixed on the carriage 16. The bearings 33 are engaged with the guide rail 24 (refer to FIG. 2) and serves to guide the carriage 16 in the arrow B direction in accordance with a predetermined signal.

Figure 4:
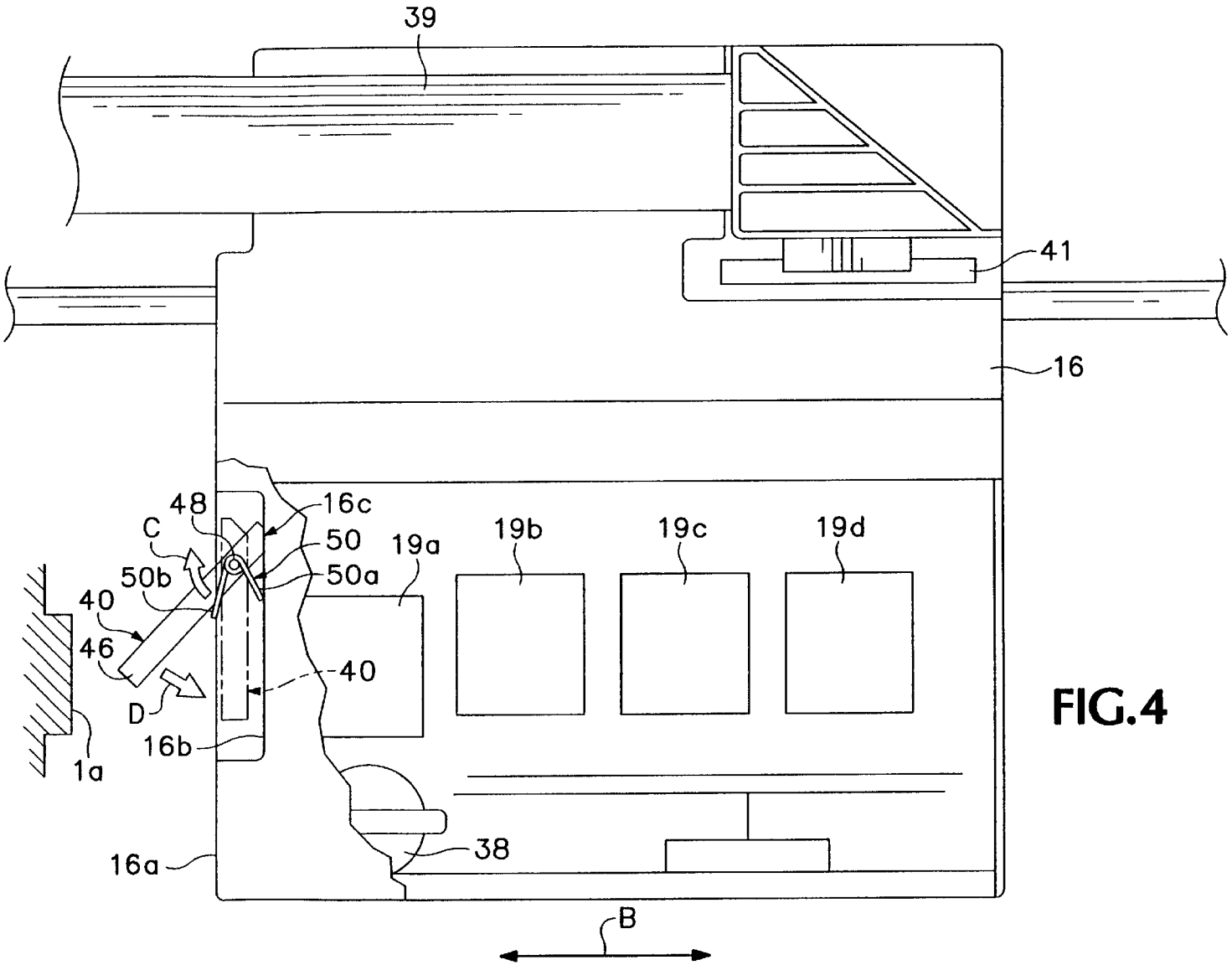
FIG. 4 is a plan view of the carriage.

The image position detector 40 has an upper bearing 42 and a lower bearing 44, which are fixed on the carriage 16, and in addition an attachment 46 which is rotatably fixed on the upper bearing 42 and the lower bearing 44 through a shaft 48 (refer to FIG. 4). The image position detector 40 serves to detect a position of an image formed on a recording medium so that the respective color print heads 19*a*, 19*b*, 19*c* and 19*d* perform printing with great accuracy of consistency.

With reference to FIG. 4 there will be explained an operation of the image position detector 40.

The respective color print heads 19*a*, 19*b*, 19*c* and 19*d*, which are loaded on the carriage 16, are detachable by rotation of a dial 38. A connector 41, which a cable 39 is connected to, is fixed on the carriage 16. A predetermined signal is fed from the main frame of the plotter 1 via the cable 39 and the connector 41 to an electric equipment section (not illustrated) of the inside of the carriage 16. The predetermined signal is applied to the respective color print heads 19*a*, 19*b*, 19*c* and 19*d*, so that inks are ejected from the respective color print heads 19*a*, 19*b*, 19*c* and 19*d* in accordance with the applied signal to form an image on a recording medium.

The image position detector 40 is arranged to incline 45° with respect to an edge 16*a* in a scanning direction (the arrow B direction) of the carriage 16 so that a part of the image position detector 40 projects from the edge 16*a*. In this inclined state, the image position detector 40 detects print positions of the respective color print heads 19*a*, 19*b*, 19*c* and 19*d* on the basis of an X axis (an axis extending in a conveyance direction of the recording medium) of the recording medium and a Y axis (an axis perpendicularly intersecting the X axis) of the recording medium, and regulates the print positions of the respective color print heads 19*a*, 19*b*, 19*c* and 19*d* if the print positions are not appropriate. A helical torsion coil spring (an example of the movement means referred to in the present invention) 50 is fixed on a shaft 48 for rotatably supporting the attachment 46 of the image position detector 40. One end 50*a* of the helical torsion coil spring 50 is in contact with a wall 16*b* of the carriage 16, and another end 50*b* of the helical torsion coil spring 50 enables the attachment 46 in an arrow C direction. The enabling the attachment 46 causes the image position detector 40 to incline 45° with respect to the edge 16*a* in the scanning direction (the arrow B direction) of the carriage 16, as mentioned above.

When the carriage 16 locates at the edge side in the arrow B direction within the scanning range, the attachment 46 is in contact with a main frame side wall 1*a* of the plotter 1 and rotates in an arrow D direction against the enabling force of the helical torsion coil spring 50 in the arrow C direction so that the image position detector 40 is stored in a storage unit 16*c*. The storage unit 16*c* thus stored is shown by the two-dot chain line. Thus, when the image position detector 40 is operative, a part of the image position detector projects from the carriage 16 owing to the enabling of the helical torsion coil spring 50. On the other hand, when the carriage 16 is in contact with the main frame side wall 1*a* of the plotter 1, the entire image position detector 40 is stored in the storage unit 16*c*. This feature makes it possible to shorten the width of the plotter I by the corresponding length in the width direction of the projecting portion of the image position detector 40, and thereby manufacturing a compact plotter.

According to the above explanation, the attachment is always enabled by the helical torsion coil spring. It is noted however that it is also possible to accomplish the object by such an arrangement that when the attachment is unnecessary, it is stored in the carriage, and only when the attachment is necessary, the attachment is projected from the storage unit 16*c* using a motor, a solenoid and the like.

Figure 5:
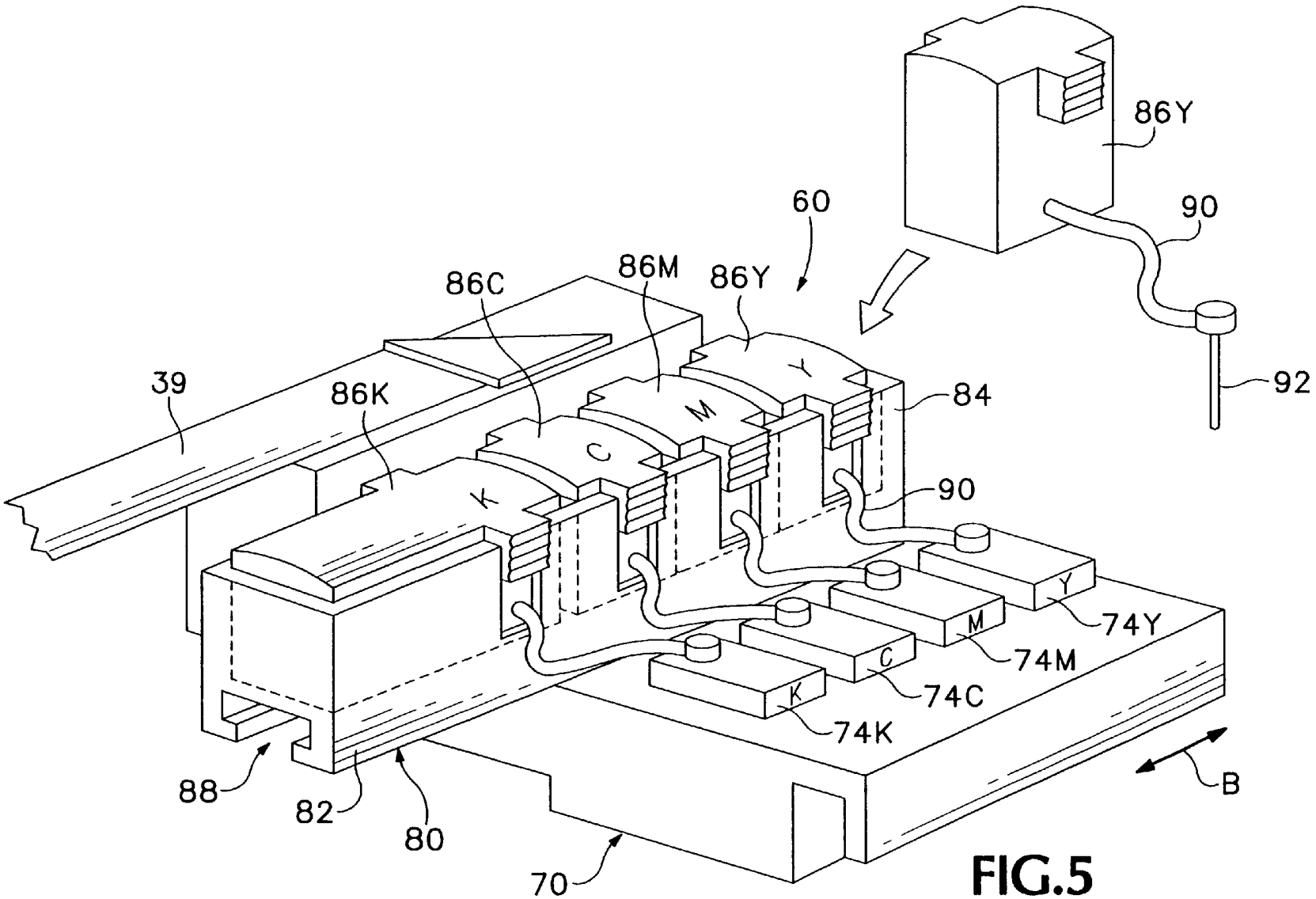
FIG. 5 is a perspective view of an alternative carriage by way of example, in which the carriage is scanned.
Figure 6:
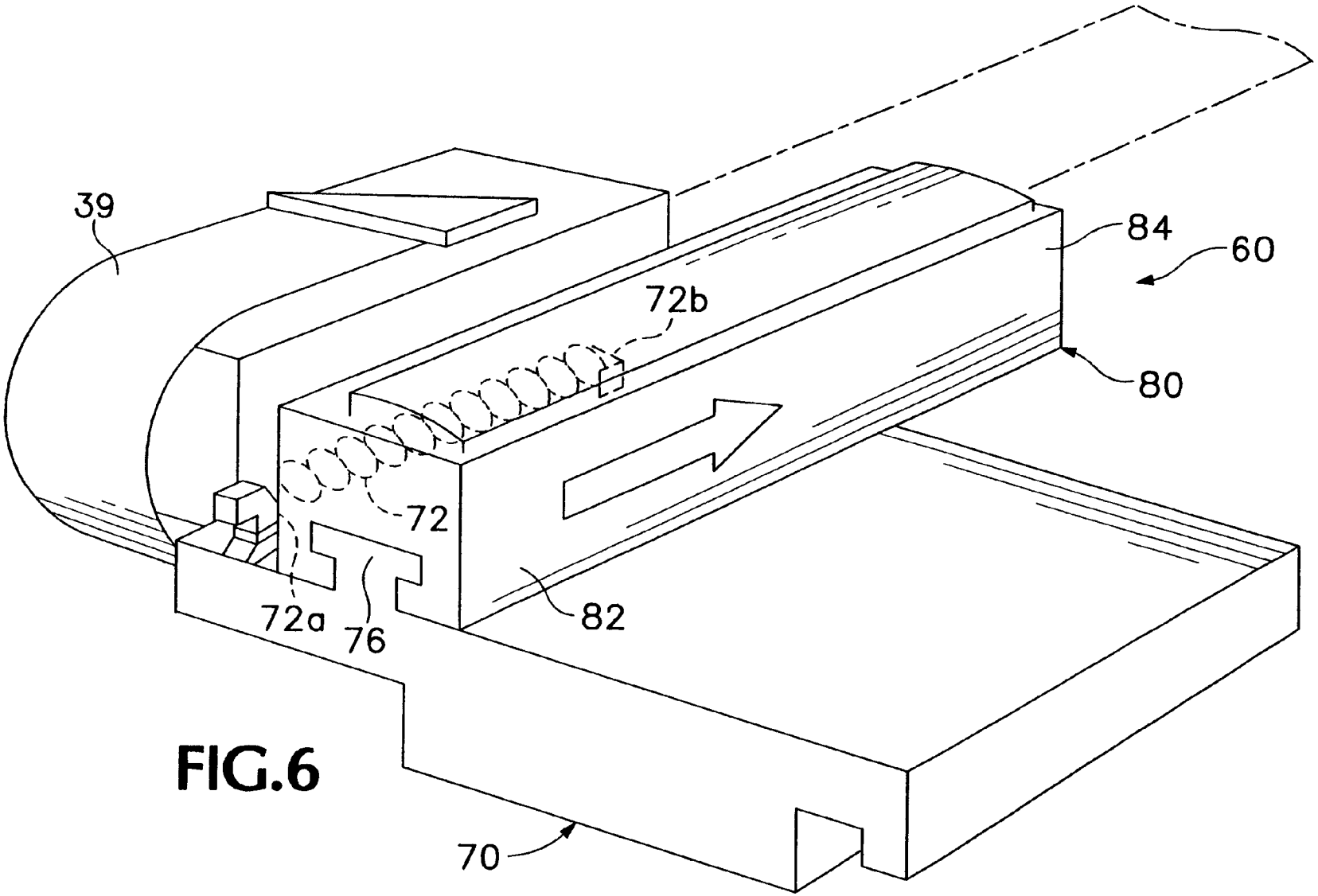
FIG. 6 is a typical illustration showing a state that the carriage shown in FIG. 5 is located at the left end with respect to the scanning direction.

With reference to FIGS. 5 and 6, there will be explained an alternative embodiment of the carriage 16. In FIGS. 5 and 6, the same parts are denoted by the same reference numbers as those of FIG. 4. Incidentally, FIG. 6 omits ink tanks and print heads shown in FIG. 5.

A carriage 60 has a main frame section 70 for scanning in a scanning direction (an arrow B direction) and a moving section 80 which is movably fixed on the main frame section 70 in such a manner that the moving section 80 may move in the scanning direction. The main frame section 70 is provided with a guide rail 76 extending in the scanning direction. On the other hand, the moving section 80 is provided with a guide groove 88 which engages with the guide rail 76. Thus, the moving section 80 can move on the main frame section 70 in the scanning direction.

A one edge portion 72*a* of a tensile coil spring 72 is fixed on the left end of the main frame section 70. Another edge portion 72*b* of the coil spring 72 is fixed on a scanning direction central portion of the moving section 80. Thus, when the carriage 60 is scanning, as shown in FIG. 5, the left side portion 82 of the moving section 80 is enabled to the left by the coil spring 72 so that the left side portion 82 projects to the left side of the main frame section 70. On the other, when the carriage 60 is translated to the left end in the scanning direction, the left side portion 82 of the moving section 80 is in contact with the main frame side wall 1*a* (cf. FIG. 4) so that the left side portion 82 is translated to the right end in the scanning direction through overcoming the enabling force of the coil spring 72. As a result, the left side portion 82 of the moving section 80 is withdrawn, while a right side portion 84 of the moving section 80 projects to the right side. In this manner, the moving section 80 projects to the left side or the right side in accordance with the position of the main frame section 70.

The main frame section 70 is loaded with print heads 74K, 74C, 74M and 74Y. The moving section 80 is loaded with ink tanks 86K, 86C, 86M and 86Y. The print heads 74K, 74C, 74M and 74Y are coupled through ink supply tubes 90 with the ink tanks 86K, 86C, 86M and 86Y, respectively, so that inks of the ink tanks 86K, 86C, 86M and 86Y are supplied to the print heads 74K, 74C, 74M and 74Y, respectively. An ink supply needle 92 is fixed on the tip of each of the ink supply tubes 90, and is sticked into a sponge incorporated into each of the print heads 74K, 74C, 74M and 74Y.

As mentioned above, according to the present embodiment, the moving section 80 projects to the left side or the right side in accordance with the position of the main frame section 70, and thus it is possible to enlarge each of the ink tanks in the scanning direction by the corresponding projecting size and thereby saving a large amount of ink. As a result, it is possible to supply much amount of ink to the print heads without enlarging the outside dimension of the plotter.

Figure 7:
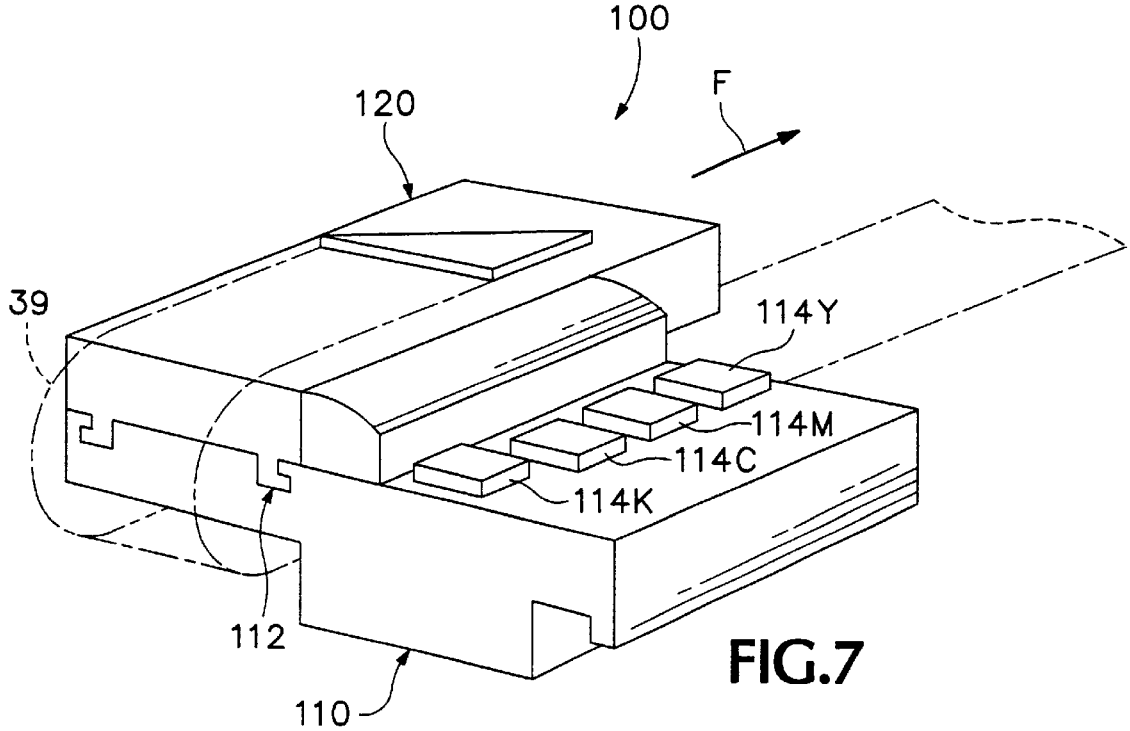
FIG. 7 is a perspective view of a further alternative carriage by way of example, showing a state that the carriage is located at the left end with respect to the scanning direction.
Figure 8:
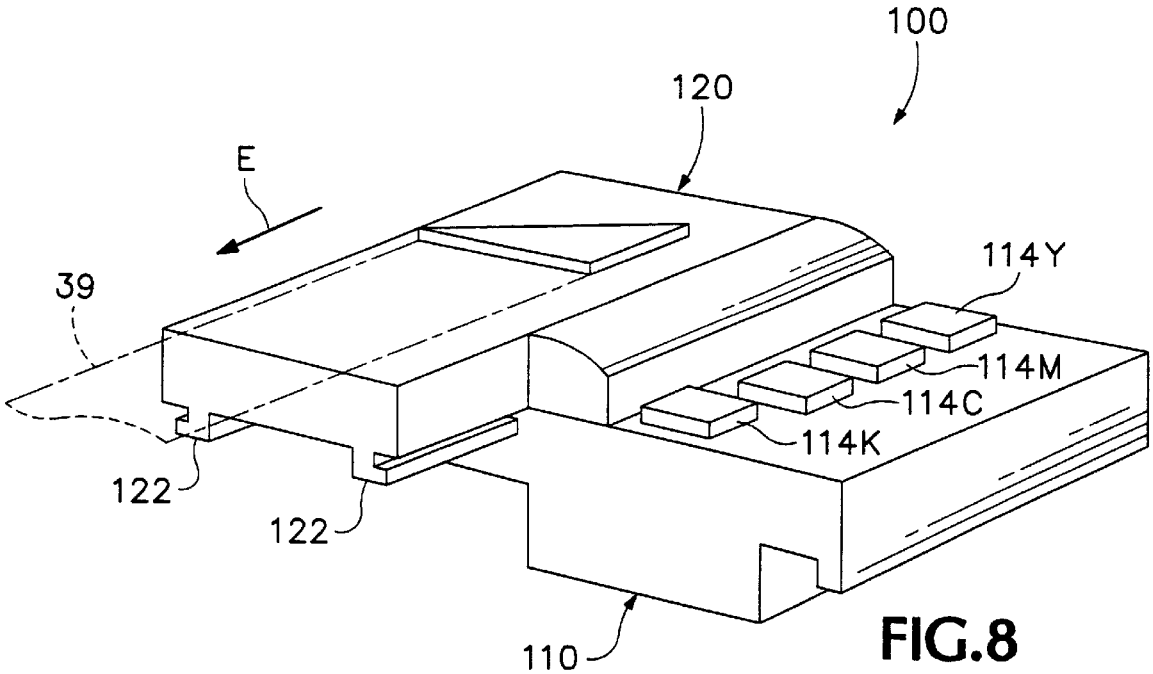
FIG. 8 is a typical illustration showing a state that the carriage shown in FIG. 7 is located at the right end with respect to the scanning direction.
Figure 9:
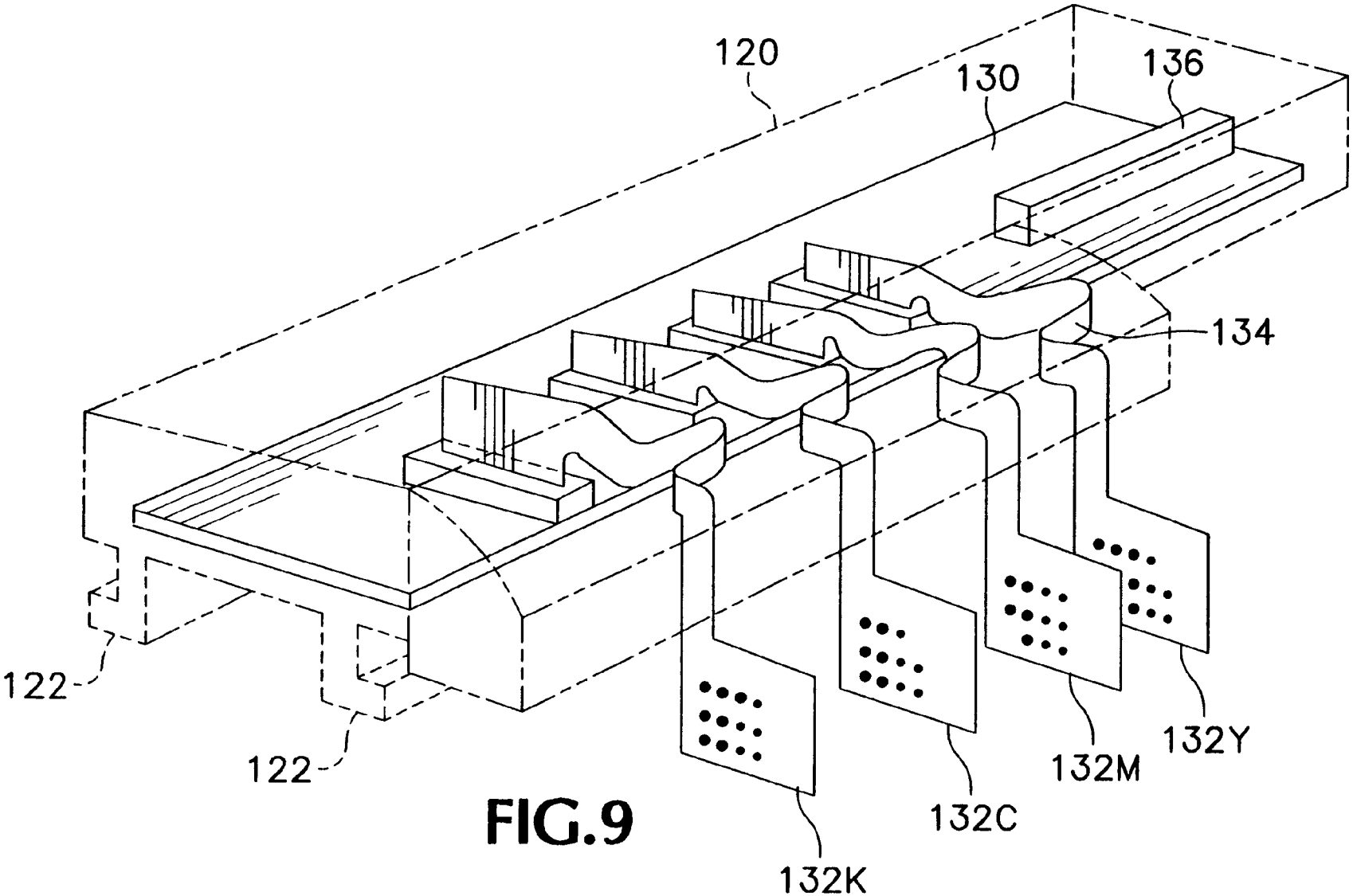
FIG. 9 is a perspective view typically illustrating the inside of the moving member.

With reference to FIGS. 7, 8 and 9, there will be explained a further alternative embodiment of the carriage 16. In FIGS. 7–9, the same parts are denoted by the same reference numbers as those of FIG. 4.

A carriage 100 has a main frame section 110 for scanning in scanning directions (an arrow E direction, an arrow F direction) and a moving section 120 which is movably fixed on the main frame section 110 in such a manner that the moving section 120 may move in the scanning direction. The main frame section 110 is provided with a guide groove 112 extending in the scanning directions. On the other hand, the moving section 120 is provided with a guide rail 122 which engages with the guide groove 112. Thus, the moving section 80 can move on the mainframe section 70 in the scanning directions.

The main frame section 110 is loaded with print heads 114K, 114C, 114M and 114Y. The moving section 120 is loaded with a junction substrate 130 for supplying signals and electric power. A cable 39 is connected to the junction substrate 130. Also connected to the junction substrate 130 are one ends of flexible signal lines 132K, 132C, 132M and 132Y, which are connected to the print heads 114K, 114C, 114M and 114Y, respectively. On the central portion of each of the flexible signal lines 132K, 132C, 132M and 132Y, there is formed a U-like shaped curved portion 134 so that the respective flexible signal lines do not undergo stress involved in a movement of the moving section 120. On the junction substrate 130, there is also mounted a connector 136 of the cable 39 for connecting the junction substrate 130 with an engine controller (not illustrated).

When the carriage 100 is translated to the left end in the scanning direction, as shown in FIG. 7, the moving section 120 is urged by the main frame side wall 1*a* (cf. FIG. 4) in the arrow F direction, so that the right side portion of the moving section 120 projects into the right side with respect to the main frame section 110. On the other hand, when the carriage 100 is translated to the right end in the scanning direction, the moving section 120 is urged in the arrow E direction by a main frame side wall (not illustrated) corresponding to the main frame side wall 1*a,* which is located at the right side of the main frame, so that the left side portion of the moving section 120 projects into the left side with respect to the main frame section 110. In this manner, according to the present embodiment, the moving section 120 projects to the left side or the right side in accordance with the position of the main frame section 110.

As mentioned above, since the moving section 120 projects to the left side or the right side in accordance with the position of the main frame section 110, it is possible to enlarge the junction substrate 130 in the scanning direction by the corresponding projecting size. As a result, it is possible to shorten the junction substrate 130 in a direction (width direction) perpendicularly intersecting the scanning direction, and thereby implementing compactness of the apparatus in its entirety by the correspondence.

According to the present embodiment, the moving section 120 is translated while being in contact with the main frame side wall. However, it is acceptable to provide such an arrangement that the length of the cable 39 connected to the connector 136 of the moving section 120 is shortened so that a margin involved in a translation of the main frame section 110 to the edge in the scanning direction is removed thereby limiting a moving area of the moving section 120 by the cable 39, and the moving section 120 is translated from the main frame section 110 which is now travelling in the edge direction.

INDUSTRIAL APPLICABILITY

As explained above, according to the first scanning type image formation apparatus of the present invention, a part or the whole of the attachment means is stored in the inside of the scanning means by the moving means. This feature may bring about such an advantage that even if the attachment means is attached to the scanning means, there is no need to extend the corresponding width.

Further, according to the second scanning type image formation apparatus of the present invention, when the scanning means is located at the edge side in a predetermined direction within the scanning range, a part or the whole of the attachment means is stored in the inside of the scanning means by the moving means. This feature may bring about such an advantage that even if the attachment means is attached to the scanning means, there is no need to extend the corresponding width.

In the above-mentioned first or second scanning type image formation apparatus of the present invention, in the event that the attachment means is an image matching apparatus for detecting a position of an image formed on a recording medium to establish a matching of the image formed on the recording medium, it is possible to effectively shorten the width of the scanning type image formation apparatus.

Furthermore, according to the third scanning type image formation apparatus of the present invention, the moving section projects in a predetermined direction with respect to the main frame section and is movable in the predetermined direction. This feature makes it possible to contribute to the more effective use by the corresponding projection as compared with the prior art.

In the above-mentioned third scanning type image formation apparatus of the present invention, in the event that the moving section loads ink tanks for supplying inks to print heads for ejecting inks, it is possible to load larger ink tanks by the corresponding projection as compared with the prior art.

In the above-mentioned third scanning type image formation apparatus of the present invention, in the event that the moving section loads a junction substrate for supplying signals and electric power, it is possible to load longer junction substrate by the corresponding projection as compared with the prior art and thereby shortening length of the junction substrate in a direction perpendicularly intersecting the projecting direction.

What is claimed is:

1. A scanning type image formation apparatus having scanning means for scanning in a predetermined direction, in which said scanning means is scanned in the predetermined direction to form an image on a recording medium, said scanning type image formation apparatus comprising:

attachment means attached to an edge of said scanning means in the predetermined direction, said attachment means performing a predetermined function; and moving means for moving said attachment means relative to said scanning means in such a manner that when said attachment means performs the predetermined function, a part or the whole of said attachment means projects from the edge of said scanning means.

2. A scanning type image formation apparatus according to claim 1 wherein said attachment means is an image matching apparatus for detecting a position of an image formed on a recording medium to establish a matching of the image formed on the recording medium.

3. A scanning type image formation apparatus according to claim 1 wherein said attachment means comprises an image position sensor.

4. A scanning type image formation apparatus according to claim 3 wherein said image position sensor moves to the predetermined direction.

5. A scanning type image formation apparatus having scanning means for scanning in a predetermined direction, in which said scanning means is scanned in the predetermined direction to form an image on a recording medium, said scanning type image formation apparatus comprising:

attachment means attached to an edge of said scanning means in the predetermined direction, said attachment means performing a predetermined function; and moving means for moving said attachment means in relation to said scanning means in such a manner that when said attachment means performs the predetermined function, a part or the whole of said attachment means projects from the edge of said scanning means, and when said scanning means is located at an edge side in the predetermined direction within the scanning range, a part or the whole of the attachment means is stored in an inside of said scanning means.

6. A scanning type image formation apparatus according to claim 5 wherein said attachment means is an image matching apparatus for detecting a position of an image formed on a recording medium to establish a matching of the image formed on recording medium.

7. A scanning type image formation apparatus having a carriage for scanning in a predetermined direction, in which said scanning means is scanned in the predetermined direction to form an image on a recording medium, said carriage comprising:

a main frame section for scanning in the predetermined direction;

a moving section projecting in the predetermined direction with respect to said main frame section, said moving section being movably fixed on said main frame section in such a manner that said moving section is movable relative to said main frame section in the predetermined direction.

8. A scanning type image formation apparatus according to claim 7 wherein said moving section carries ink tanks for supplying inks to print heads for ejecting inks.

9. A scanning type image formation apparatus according to claim 7 wherein said moving section carries a junction substrate for supplying signals and electric power.

* * * * *